US005709759A

United States Patent [19]

Ljungars et al.

[11] Patent Number: 5,709,759

[45] Date of Patent: Jan. 20, 1998

[54] METHOD OF WORKING A HOT-ROLLED STRIP

[75] Inventors: Sten Ljungars; Christer Herre, both of Torshälla, Sweden

[73] Assignee: Avesta Sheffield Aktiebdag (publ), Stockholm, Sweden

[21] Appl. No.: 635,715

[22] Filed: Apr. 22, 1996

[30] Foreign Application Priority Data

Apr. 21, 1995 [SE] Sweden ..... 9501459

[51] Int. Cl.[6] ..... C21D 8/02

[52] U.S. Cl. ..... 148/645; 148/610; 148/651

[58] Field of Search ..... 148/599, 610, 148/603, 645, 651

[56] References Cited

U.S. PATENT DOCUMENTS 4,726,853 2/1988 Gressin et al. ..... 148/610

5,571,343 11/1996 Ryoo et al. ..... 148/610

*Primary Examiner*—Deborah Yee

*Attorney, Agent, or Firm*—Nixon & Vanderhye

[57] ABSTRACT

The invention relates to a method of working a hot-rolled stainless steel strip, particularly an austenitic stainless strip, with the intention of reducing the thickness and enhancing the mechanical strength of the strip. The method is characterized by cold-rolling the hot-rolled strip with at least a 10% thickness reduction to a thickness which is at least 2% and at most 10% greater than the intended final thickness of the finished product;

annealing the thus cold-rolled strip at a temperature of between 1,050° C. and 1,250° C.; and cold-stretching the strip after the annealing process so as to plasticize and permanently elongate the strip and therewith reducing its thickness by 2–10%.

6 Claims, 5 Drawing Sheets

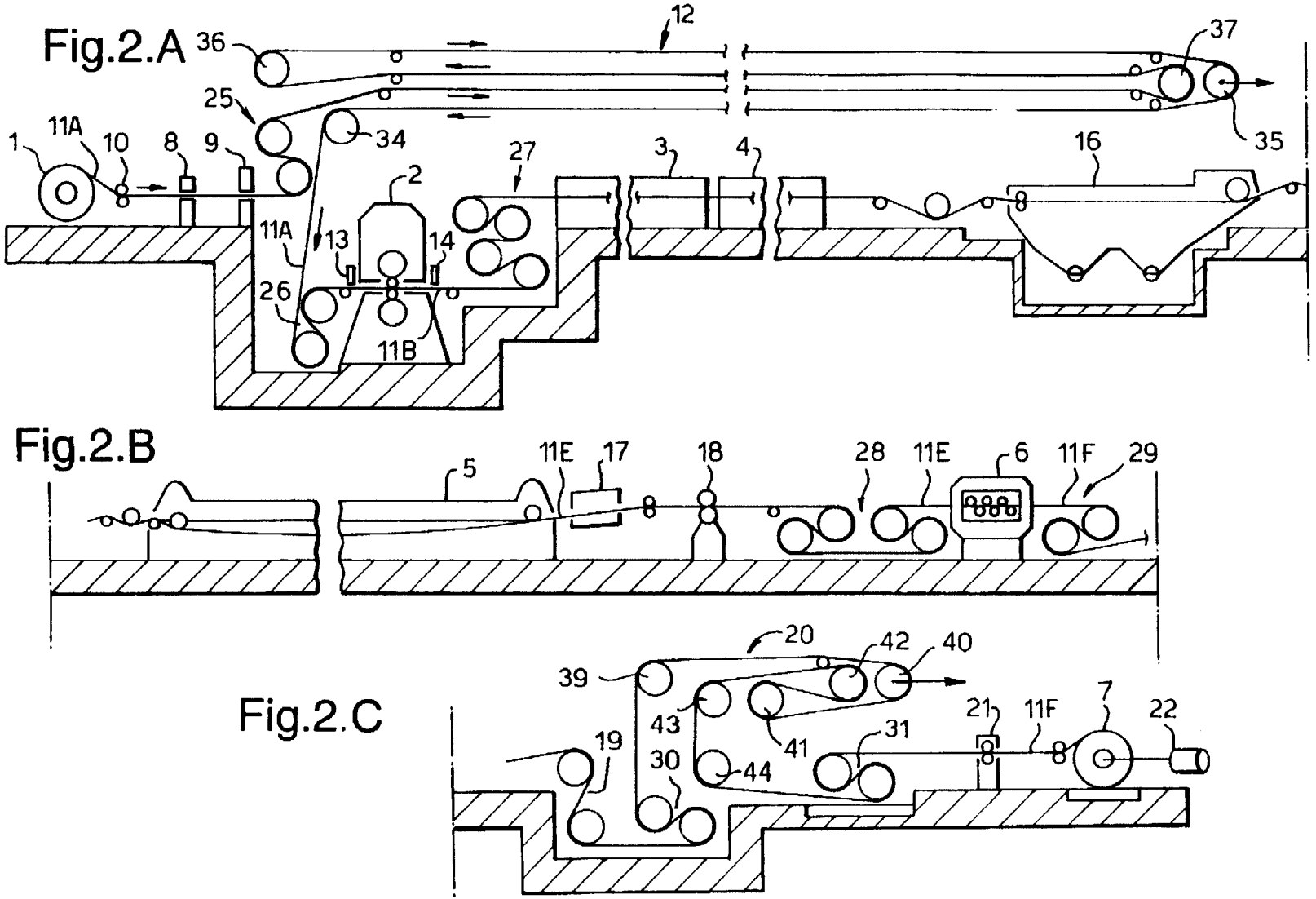
Fig.2.A
Fig.2.B
Fig.2.C

METHOD OF WORKING A HOT-ROLLED STRIP

TECHNICAL FIELD

The present invention relates to a method of working a hot-rolled stainless steel strip, in particular an austenitic stainless steel strip, for the purpose of reducing thickness, enhancing mechanical strength and providing a good surface finish.

DESCRIPTION OF THE BACKGROUND ART

Stainless steel strips can be hot-rolled to a final thickness of the order of 3 mm. After surface conditioning the strips, including among other things pickling the strip, the hot-rolled strips can be used without further thickness reduction in certain applications. However, subsequent cold-rolling of the hot-rolled strips is required in many other applications. This subsequent cold-rolling process is intended to achieve one or more or all of the following effects, viz to further reduce the thickness of the strips, to enhance the mechanical strength and/or to improve the surfaces of the strips.

Before being cold-rolled, the hot-rolled strips are annealed and pickled, and scrap-ends are welded onto both ends of the strips. The actual cold-rolling process is carried out conventionally in several passes through a cold-rolling mill, therewith enabling the thickness to be reduced by up to about 80%, normally 0–60%, for instance for cold-rolled strips which are intended for use as construction materials after having been slit into narrower strips. The scrap-ends must be removed before the strip can finally be coiled.

Cold-rolling dramatically increases the mechanical strength of the steel, which is in itself desirable for many applications, and this particularly concerns cold-rolling of austenitic stainless steel. However, the strips also become practically impossible to work, e.g. to bend, stamp, emboss, etc.; properties which are in many cases necessary in order to enable the strips to be used as construction materials. It is therefore necessary to anneal the strips upon completion of the cold-rolling process, by heating the strips to a temperature above the re-crystallization temperature of the steel, i.e. to a temperature above 1,050° C. This treatment greatly reduces the mechanical strength of the strip, normally to an order of magnitude of 250 MPa yield point. According to current standards, a yield point of 190–220 MPa must be calculated for in construction work.

The properties obtained with conventional techniques, for instance a relatively low yield point, are desirable properties in the majority of cases, although conventional techniques are irrational in several aspects. However, improvements have been proposed with the intention of rationalizing manufacture. For instance, it is proposed in SE 467 055 (WO 93/19211) to reduce thickness in conjunction with an annealing process by stretching the hot strip. However, a higher mechanical strength is a desirable property in certain applications, such as for constructional applications. The properties of the final cold-rolled strip are not improved in this latter respect when practicing the aforesaid method, and neither is such improvement intended.

SUMMARY OF THE INVENTION

The object of the invention is to produce stainless steel strips, particularly stainless austenitic steel strips, having a desired thin thickness and a higher mechanical strength than that achieved in the conventional manufacture of cold-rolled stainless austenitic steel strips while obtaining an acceptable surface finish at the same time. These and other objects can be achieved by cold-rolling a hot-rolled strip with an at least 10% thickness reduction to a thickness which is at least 2% and at most 10% greater than the intended final thickness of the finished product, by annealing the thus cold-rolled strip at a temperature of between 1,050° C. and 1,200° C., and cold-stretching the strip after said annealing process so as to plasticize and permanently elongate the strip, therewith obtaining a reduction in thickness of 2–10%.

The strip which is subjected to cold-rolling in accordance with the invention may consist of a hot-rolled strip that has not undergone any treatment other than being cooled and coiled after being hot-rolled. Thus, in this case, cold-rolling is performed on a hot-rolled strip on which oxide scale still remains on the surfaces thereof. However, the starting material for the cold-rolling process also may consist of a strip which has been surface-treated by a process technique that includes pickling of the hot-rolled strip.

In principle, the cold-rolling process can be carried out in several passes through a corresponding number of mutually sequential roll stands, although it will preferably be carried out in one single pass. The maximum reduction in thickness that can be achieved in one single pass will depend on the steel grade, the initial dimensions of the strip, and the capacity of the rolling mill. It can be said generally that one single pass will result in a maximum thickness reduction of about 30%, normally at maximum 25%. This means that in the majority of cases, the thickness of the hot rolled strip will be reduced by 10 to 60%, preferably by 10 to 40% when practicing the invention, this reduction being dependent on the initial thickness of the strip and the final thickness desired. The strip is annealed at a temperature of between 1,050° C. and 1,200° C. and then cooled to room temperature before being cold-stretched.

The strip is cold-stretched in a strip stretching mill which may be of any known kind, for instance the kind used to de-scale the surfaces of hot-rolled strips prior to pickling. The strip is preferably cold-stretched by a combination of high stretches and bending of the strip around rolls. The cold-stretching process is carried out to a degree such as to permanently elongate the strip and therewith obtain a thickness reduction of 2–10%. As a result of the combination of high stretches and bending of the strip around rolls of relatively small diameter, the decrease in width will be minimal and practically negligible. The reduction in strip thickness will therefore correspond essentially to the degree of elongation achieved. The material is plasticized as a result of the cold-stretching process, the yield point increasing in the order of 100 MPa, and still higher in the case of certain steel grades.

A characteristic feature of the inventive method is that it takes place continuously, by which is meant that the method does not include any reversing steps, for instance reverse rolling, re-coiling between the various steps or like reverses. In order to make a continuous process possible, the manufacturing line preferably includes, in a known manner, strip magazines, so called loopers, at the beginning and at the end of the manufacturing chain, i.e. prior to cold-rolling and subsequent to cold-stretching of the strip.

The inventive method will normally also include pickling of the annealed strip. The strip is preferably pickled prior to being cold-stretched, although it is also conceivable to pickle the strip after the cold-stretching process. The strip is preferably shot-blasted prior to being pickled.

Further characteristic features and aspects of the invention and advantages afforded thereby, together with the properties of the product produced will be apparent from the following detailed description of the invention and from the following claims.

BRIEF DESCRIPTION OF THE DRAWINGS

The invention will now be described in more detail with reference to the accompanying drawings, in which

FIG. 2 illustrates in more detail the manufacturing line according to the preferred embodiment;

DETAILED DESCRIPTION OF THE INVENTION

Figure 1:
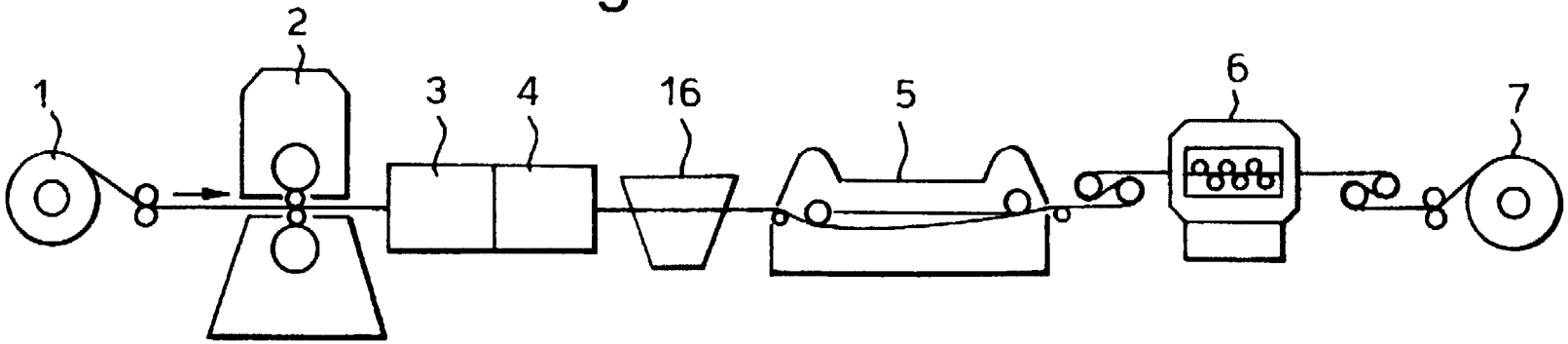
FIG. 1 illustrates very schematically the principles of the invention according to a first preferred embodiment.

The manufacturing line illustrated very schematically in FIG. 1 comprises a coil loof (rewinder) hot-rolled strip to be uncoiled, uncoiling capstan 1, a cold-rolling mill 2 consisting of one single roll stand 2 of the so-called Z-high type, an annealing furnace 3, a cooling box 4, a shot-blasting machine 16, a pickling bath 5, a cold-stretching mill 6 and a recoiler 7 which takes up the finished steel strip.

FIG. 2 shows the manufacturing line in more detail, wherein the same reference numerals have been used for units that find correspondence in FIG. 1. In addition to the aforesaid units, the manufacturing line also includes a shearing unit 8, a welding machine 9, a strip feeder 10 which feeds hot-rolled strip 11 taken from the rewinder 1 to the shearing unit 8 and the welding machine 9, a hot-rolled strip looper generally referenced 12, a thickness measuring means 13 which measures the thickness of the hot-rolled strip 11 upstream of the rolling mill 2, and a thickness measuring means 14 which measures the thickness of the cold-rolled strip 11B downstream of the cold-rolling mill 2, the shot-blasting machine 16, a wiping and rinsing box 17 downstream of the pickling bath 5, a pair of guide rollers 18, the cold-stretching mill 6, a looper generally referenced 20 for the storage of cold-rolled and cold-stretched finished strip 11F, a front feeder 21, and a drive motor and power transmission means together referenced 22 for operating the recoiler 7.

The manufacturing line also includes a large number of guide rollers, direction changing rollers, and an S-mill arrangement that comprises two or four rolls. The S-mill arrangement is thus comprised of a two-roll S-mill 25 downstream of the welding machine 9, a two-roll S-mill 26 upstream of the cold-rolling mill 2, a four-roll S-mill 27 between the cold-rolling mill 2 and the annealing furnace 3, a four-roll S-mill 28 upstream of the cold-stretching mill 6, a two-roll S-mill 29 downstream of the cold-stretching mill 6, a strip centre guide 19, the strip magazine 20, and a terminating two-roll S-unit 31 between the looper 20 and the recoiler 7. The primary function of the S-mill is to increase or decrease the tension in the strip and to keep the strip in tension.

The hot-rolled strip looper 12 includes direction changing rollers 34,35,36 and 37, of which the roller 35 is coupled to a strip tensioning unit in a known manner. Correspondingly, the cold-rolled strip looper 20 includes direction changing rollers 39, 40, 41, 42, 43 and 44, of which the roller 40 is connected to a strip tensioning unit, also in a known manner.

The manufacturing line illustrated in FIG. 2 operates in the following manner. It is assumed that manufacture is in the phase illustrated in the Figure, i.e. that the hot-rolled strip looper 12 and the cold-rolled strip looper 20 contain a given amount of strip, that hot-rolled strip 11A is being uncoiled from the rewinder 1, and that the finished strip 11F is being coiled on the recoiler 7. The line is driven by several driven rollers, primarily driven S-mill rollers in a known manner. After having passed through the hot-rolled strip looper 12, the thickness of the strip is measured with the aid of the thickness measuring means 13 upstream of the cold-rolling mill 2 and is cold-rolled in the mill 2 in one single pass, whereafter the thickness of the cold-rolled strip 11B is measured by the thickness measuring means 14. The hot-rolled strip 11A will normally have an initial thickness of 3 to 4 mm and is reduced by 10–30% in the cold-rolling mill 2. The roll nip is adjusted in accordance with the results of the thickness measurements so as to obtain a cold-rolled strip 11B of desired thickness, corresponding to 2–10% greater than the intended finished dimension after cold-stretching the strip in the terminating part of the manufacturing line.

The cold-rolling process imparts a high degree of hardness to the strip 11B, and the strip is therefore passed into the annealing furnace 3 after having passed the four-roller S-mill 27. The strip 11B is heated throughout its thickness in the annealing furnace 3 to a temperature of between 1,050° C. and 1,200° C., i.e. to a temperature above the re-crystallization temperature of the austenitic steel, and is maintained at this temperature long enough for the steel to re-crystallize completely. The strip is then cooled in the cooling box 4. When heating the strip in the annealing furnace 3, which in accordance with the present embodiment does not take place in a protecting gas atmosphere (something which would be possible per se), oxides form on the sides of the strip, partially in the form of oxide scale. The strip is substantially de-scaled in the shot-blasting machine 6, and then pickled in the pickling bath 5 comprised of appropriate pickling chemicals, wherein the pickling process can be effected in a known manner. The thus cold-rolled, annealed and pickled strip 11E is led through the wiping and rinsing box 17 and thereafter through the cold-stretching mill 6 between the four-roller S-mill 28 and the two-roller S-mill 29 which function to hold the strip in tension and prevent the same from sliding.

Figure 3:
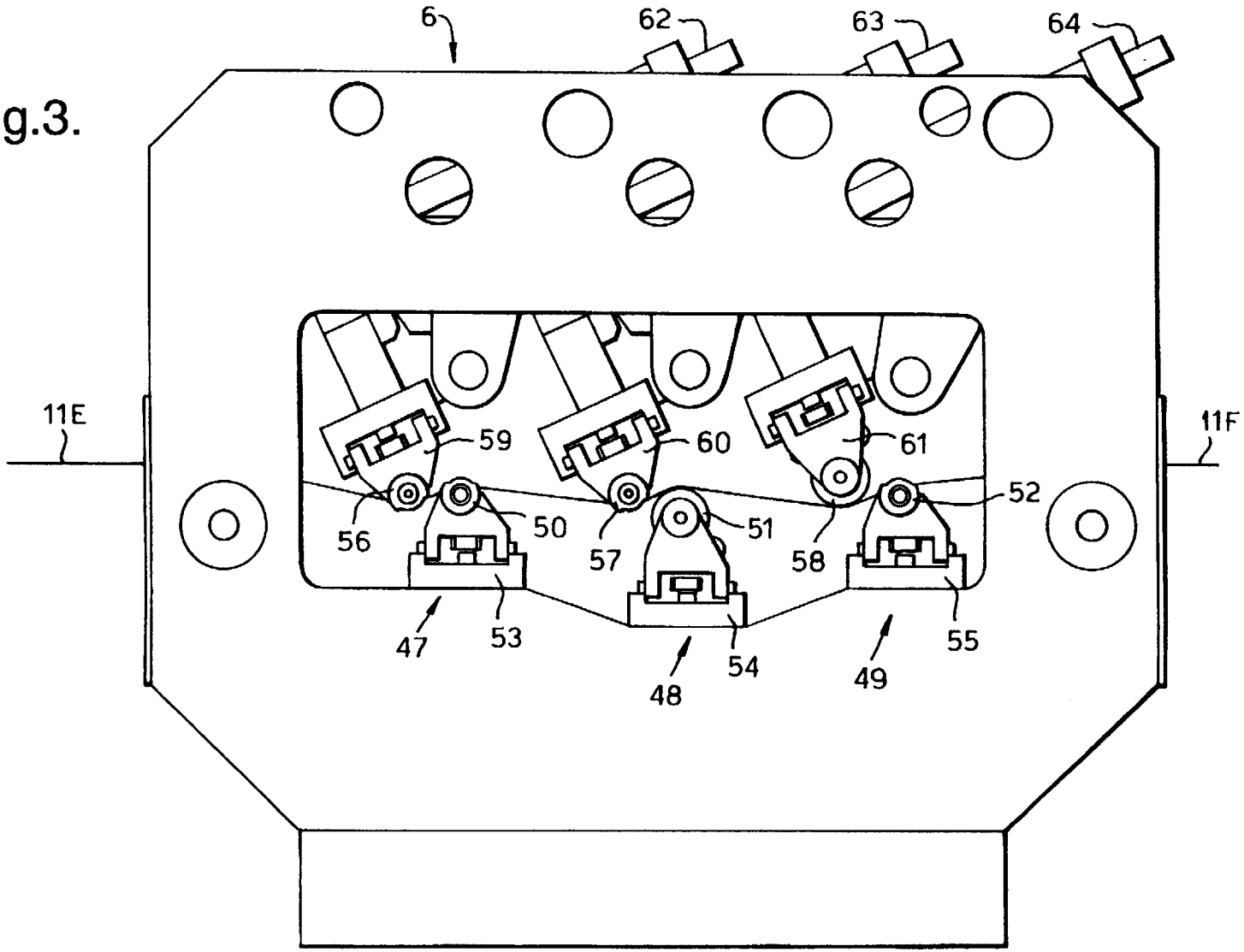
FIG. 3 illustrates in larger scale and in more detail a cold-stretching mill used in the inventive method.

FIG. 3 illustrates the design of the cold-stretching mill 6. The cold-stretching mill 6 comprises three strip-stretching units 47, 48 and 49. Each stretching unit includes a respective lower roller 50, 51, 52 journalled in a stationary base 53, 54, 55, and a respective upper stretching roller 56, 57, 58 journalled in a respective roller holder 59, 60, 61. The positions of the roller holders in relation to the strip and in relation to the lower stretching rollers 50, 51, 52 can be adjusted by means of jacks 62, 63, 64 respectively. The upper strip-stretching rollers 56, 57, 58 are initially in upper positions (not shown), so that the strip 11E, which is held stretched between the S-mills 28 and 29, will extend straight through the cold-stretching mill 6. Starting from this initial position, the upper stretching rollers 56, 57 and 58 are lowered by means of the jacks 62, 63, 64 to the positions shown in FIG. 3, whereby the strip 11E–11F will form a winding passway, as shown in FIG. 3, while at the same time being stretched in its cold state to a degree of such high magnitude as to plasticize the strip. According to the illustrated embodiment, the lower stretching rollers 50, 51 and 52 have diameters of 70, 200 and 70 mm respectively, whereas the upper stretching rollers 56, 57 and 58 have diameters of 70, 70 and 200 mm respectively. As a result of the chosen setting of the adjustable upper strip-stretching rollers 56, 57, 58 and by virtue of the chosen diameters of the rollers, that part of the strip which passes through the cold-stretching mill will be plasticized as the strip continues to be drawn through said mill 6 and to be bent about the stretching rollers, therewith obtaining permanent elongation of the strip and therewith a reduction in strip thickness of 2–10%, normally 2–5%. The width of the strip is also reduced slightly at the same time, although the reduction is only one-tenth of the elongation and can be essentially ignored. The permanent elongation of the strip also results in a thickness reduction which corresponds essentially to the elongation of the strip. A finished strip 11F of desired final thickness can be obtained by adapting the reduction in strip thickness achieved by cold-rolling the strip in the cold-rolling mill 2 to the thickness reduction obtained by cold-stretching the strip in the cold-stretching mill 6, or vice versa, said strip being coiled onto the recoiler 7 after having passed through the cold-rolled strip looper 20. The drive machinery of the integrated manufacturing line described above consists of the drive machinery 22 coupled to the strip recoiler 7.

Figure 8:
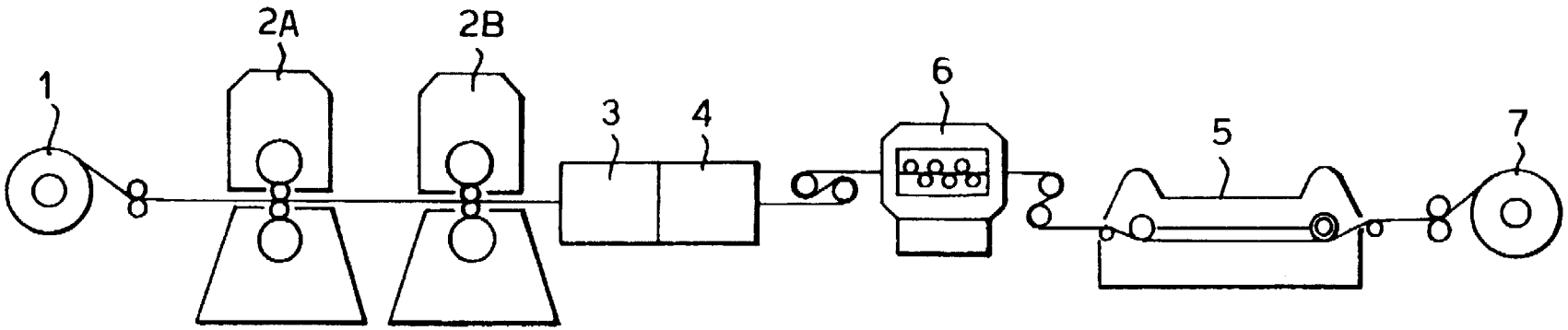
FIG. 8 illustrates highly schematically a modified manufacturing line on which the inventive method is applied.

When desiring greater reductions than those achievable with a cold-rolling mill that comprises only one roll stand and only one cold-stretching mill, a plurality of roll stands 2A, 2B, etc., can be coupled sequentially in series, as illustrated in FIG. 8. This Figure also illustrates the possibility of placing the pickling bath 5 downstream of the cold-stretching mill 6. In this case, the cold-stretching mill may also function to de-scale the strip surfaces, therewith possibly eliminating the need for a shot-blasting machine upstream of the pickling bath.

DESCRIPTION OF TESTS CARRIED OUT

Three different standardized austenitic stainless steel grades were used in the tests, ASTM 304, 316L and 316 Ti. The mechanical properties of the material were determined prior to and after cold-stretching the material, which had earlier been cold-rolled and then annealed (re-crystallization treated). The mechanical strength properties of the tested 304-material are set forth in Table 1, where e=nominal elongation in %

$R_p0.2$=0.2% proof stress in the transverse direction, MPa

Rm=ultimate tensile strength in the transverse direction, MPa

TABLE 1

| | | | Cold-rolled & annealed strip $\epsilon$ = 0% | | Cold-rolled, annealed & cold-stretched strip | |
|---|---|---|---|---|---|---|
| Test | Steel grade | Elongation $\epsilon$ % | $R_p$ 0.2 | $R_m$ | $R_p$ 0.2 | $R_m$ |
| 1 | ASTM 304 | 4.0% | 283 | 653 | 394 | 696 |
| 2 | ASTM 304 | 4.8% | 283 | 614 | 405 | 661 |
| 3 | ASTM 304 | 5.0% | 273 | 619 | 418 | 674 |

Table 2 shows measured strip widths and strip thicknesses prior to and after the strip has been cold-stretched, and also shows the percentile reductions in thickness and widths achieved in the cold-stretching process.

TABLE 2

| | Elong- | Cold rolled & annealed strip $\epsilon$ = 0% | | Cold rolled, annealed & cold stretched strip | | Difference | |
|---|---|---|---|---|---|---|---|
| Test | ation $\epsilon$ % | Width | Thick-ness | Width | Thick-ness | Width % | Thick-ness % |
| A | 3.2% | 1036 | 4.20 | 1033 | 4.07 | 0.29% | 3.10% |
| B | 3.5% | 1275 | 2.85 | 1271 | 2.75 | 0.31% | 3.51% |
| C | 4.8% | 1269 | 2.50 | 1265 | 2.40 | 0.32% | 4.00% |
| D | 4.8% | 1294 | 2.50 | 1290 | 2.39 | 0.31% | 4.40% |

Figure 4:
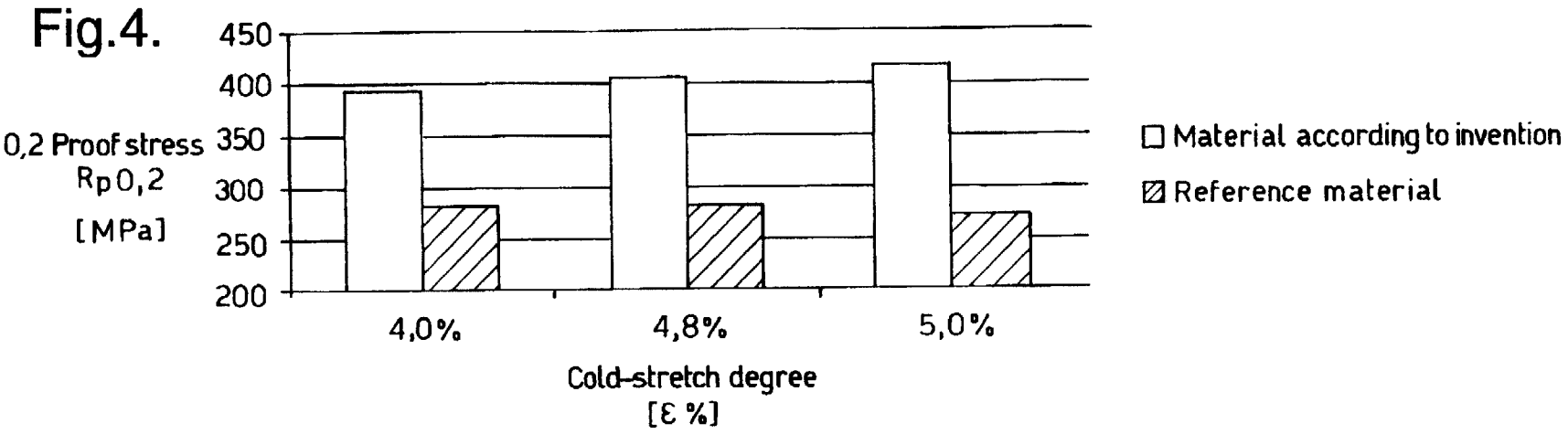
FIG. 4 is a bar chart illustrating the 0.2 proof stress values achieved before and after cold-stretching.
Figure 5:
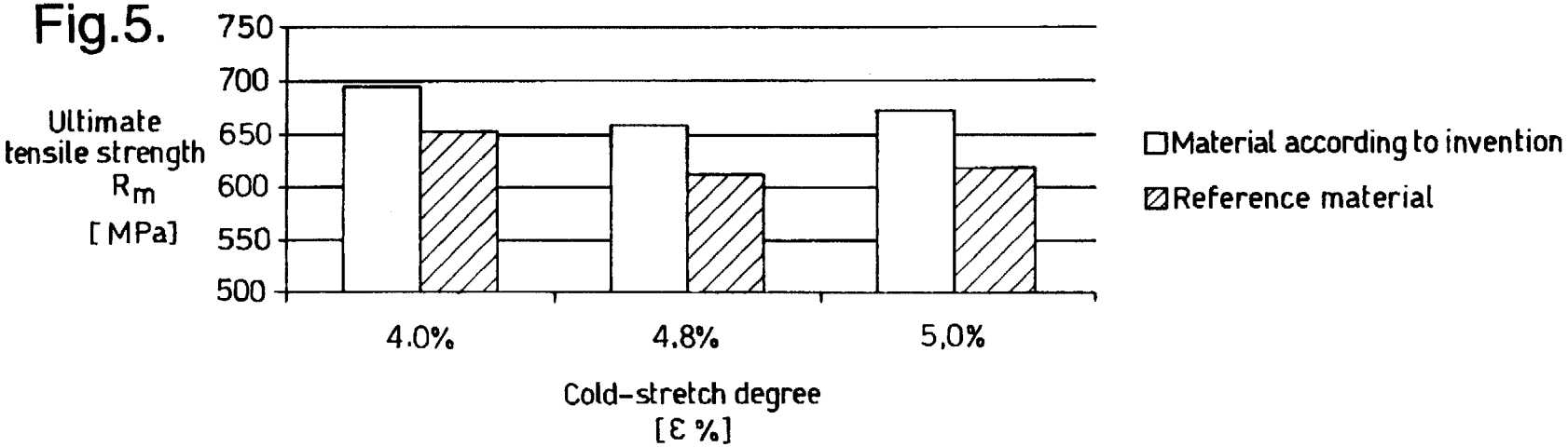
FIG. 5 illustrates achieved ultimate tensile strengths in a corresponding manner.
Figure 6:
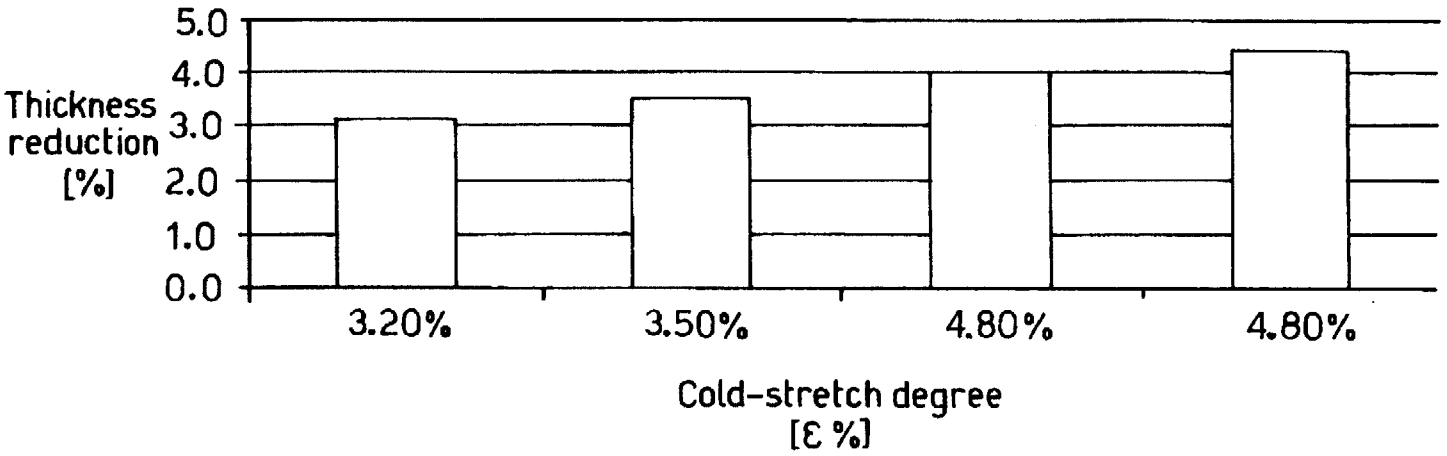
FIG. 6 is a bar chart illustrating the thickness reduction achieved with different degrees of cold-stretching.
Figure 7:
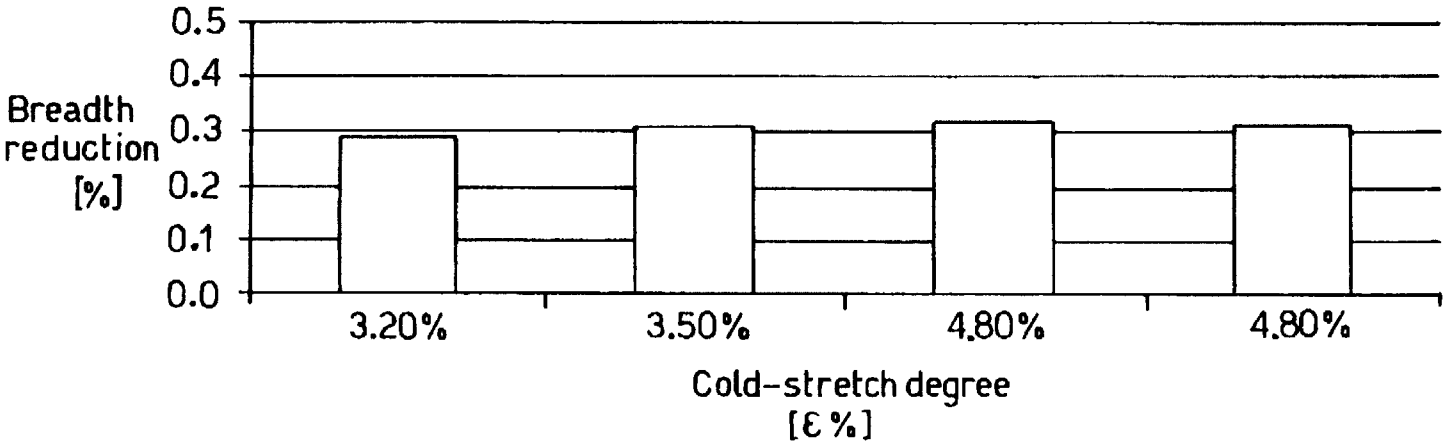
FIG. 7 illustrates the reduction in width with different degrees of cold-stretching in a corresponding manner.

The results shown in Table 1 and Table 2 are also illustrated graphically in FIGS. 4 and 5 and in FIGS. 6 and 7.

We claim:

1. A method of working a hot-rolled stainless steel strip in order to produce a finished product having a reduced thickness and enhanced mechanical strength, said method comprising the steps of:

cold-rolling a hot-rolled strip with at least a 10% thickness reduction to form a cold-rolled strip having a thickness which is at least 2% and at most 10% greater than an intended final thickness of the finished product;

annealing said cold-rolled strip at a temperature of between 1050° C. and 1250° C. to form an annealed cold-rolled strip; and cold-stretching and bending said annealed cold-rolled strip about rolls during stretching to plasticize and permanently elongate said annealed cold-rolled strip and reduce its thickness by 2–10%.

2. A method according to claim 1, wherein said annealed cold-rolled strip is pressed against said rolls and curved with a radius of curvature smaller than 200 mm.

3. A method according to claim 2, wherein said radius of curvature is at least 20 mm and at most 150 mm.

4. A method according to claim 1, wherein said hot-rolled strip is cold-rolled prior to said annealing to achieve a thickness reduction of 10–60%.

5. A method according to claim 4, wherein the hot-rolled strip is cold-rolled prior to said annealing to obtain a thickness reduction of 10–30%.

6. A method according to claim 1, wherein said annealed cold-rolled strip is continuously cold-stretched after said annealing so as to permanently elongate the strip and therewith reduce its thickness by 3–5%.

* * * * *